US012492456B2

(12) United States Patent
Ryu et al.

(10) Patent No.: US 12,492,456 B2
(45) Date of Patent: Dec. 9, 2025

(54) ULTRA HIGH STRENGTH AND HIGH DUCTILITY STEEL SHEET HAVING EXCELLENT YIELD RATIO AND MANUFACTURING METHOD FOR SAME

(71) Applicant: POSCO, Pohang-si (KR)

(72) Inventors: Joo-Hyun Ryu, Gwangyang-si (KR); Kyoo-Young Lee, Gwangyang-si (KR); Sea-Woong Lee, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 736 days.

(21) Appl. No.: 17/272,859

(22) PCT Filed: Sep. 3, 2019

(86) PCT No.: PCT/KR2019/011281
§ 371 (c)(1),
(2) Date: Mar. 2, 2021

(87) PCT Pub. No.: WO2020/050573
PCT Pub. Date: Mar. 12, 2020

(65) Prior Publication Data

US 2021/0317554 A1 Oct. 14, 2021

(30) Foreign Application Priority Data

Sep. 4, 2018 (KR) ..... 10-2018-0105634

(51) Int. Cl.

| | |
|---|---|
| ***C21D 9/46*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C23C 2/02*** | (2006.01) |
| ***C23C 2/28*** | (2006.01) |

(52) U.S. Cl.
CPC ..... *C22C 38/50* (2013.01); *C21D 8/0205* (2013.01); *C21D 8/0226* (2013.01); *C21D 8/0236* (2013.01); *C21D 9/46* (2013.01); *C22C 38/001* (2013.01); *C22C 38/02* (2013.01); *C22C 38/04* (2013.01); *C22C 38/06* (2013.01); *C22C 38/44* (2013.01); *C22C 38/46* (2013.01); *C22C 38/48* (2013.01); *C23C 2/02* (2013.01); *C23C 2/0224* (2022.08); *C23C 2/28* (2013.01); *C21D 2211/005* (2013.01); *C21D 2211/008* (2013.01)

(58) Field of Classification Search
CPC ..... C21D 9/46
See application file for complete search history.

(56) References Cited

U.S. PATENT DOCUMENTS

| | | | | |
|---|---|---|---|---|
| 2011/0186189 | A1 | 8/2011 | Futamura | |
| 2014/0050941 | A1 | 2/2014 | Kawasaki et al. | |
| 2015/0034219 | A1 | 2/2015 | Kawabe et al. | |
| 2017/0145534 | A1 | 5/2017 | Takashima et al. | |
| 2017/0327919 | A1 | 11/2017 | Kawasaki et al. | |
| 2019/0040489 | A1 | 2/2019 | Hasegawa et al. | |
| 2019/0106760 | A1 | 4/2019 | Yamashita et al. | |
| 2019/0211427 | A1* | 7/2019 | Sano | C22C 38/14 |
| 2019/0256940 | A1 | 8/2019 | Lee et al. | |
| 2019/0271051 | A1 | 9/2019 | Kawasaki et al. | |
| 2019/0284656 | A1 | 9/2019 | Kawasaki et al. | |
| 2019/0292615 | A1 | 9/2019 | Lee et al. | |
| 2020/0032362 | A1 | 1/2020 | Hasegawa et al. | |
| 2020/0087764 | A1* | 3/2020 | Sano | C22C 38/58 |
| 2020/0248281 | A1 | 8/2020 | Lee et al. | |
| 2020/0347471 | A1* | 11/2020 | Zhu | C22C 38/001 |

FOREIGN PATENT DOCUMENTS

| | | |
|---|---|---|
| CN | 103502496 | 1/2014 |
| JP | 2011157583 | 8/2011 |
| JP | 2013185196 | 9/2013 |
| JP | 5888471 | 3/2016 |
| JP | 6252709 | 12/2017 |

(Continued)

OTHER PUBLICATIONS

Chinese Office Action—Chinese Application No. 201980057937.3 issued on Sep. 16, 2021, citing KR 10-1798771, JP 6372632, JP 6252709, CN 103502496, and KR 10-1830538.

(Continued)

*Primary Examiner* — Jophy S. Koshy
(74) *Attorney, Agent, or Firm* — CANTOR COLBURN LLP

(57) ABSTRACT

An ultra high strength and high ductility steel sheet having an excellent yield ratio contains, in weight %, 0.1-0.3% of carbon (C), 2% or less of silicon (Si), 6-10% of manganese (Mn), 0.05% or less of phosphorus (P), 0.02% or less of sulfur (S), 0.02% or less of nitrogen (N), 0.5% or less (excluding 0%) of aluminum (Al), and the balance Fe and inevitable impurities, and further contains at least one selected from the group consisting of 0.1% or less of titanium (Ti), 0.1% or less of niobium (Nb), 0.2% or less of vanadium (V), and 0.5% or less of molybdenum (Mo), wherein the ultrahigh-strength and high-ductility steel sheet comprises 20 area % or more of residual austenite as a microstructure, the average aspect ratio of the residual austenite being 2.0 or higher.

4 Claims, 2 Drawing Sheets

(56) References Cited

FOREIGN PATENT DOCUMENTS

| | | | | |
|---|---|---|---|---|
| JP | 6372632 | | 8/2018 | |
| KR | 20130110634 | | 10/2013 | |
| KR | 20130138039 | | 12/2013 | |
| KR | 101586933 | | 1/2016 | |
| KR | 20170075853 | | 7/2017 | |
| KR | 101798771 | | 11/2017 | |
| KR | 101830538 | | 2/2018 | |
| WO | 2017078278 | | 5/2017 | |
| WO | 2017131053 | | 8/2017 | |
| WO | 2017183349 | | 10/2017 | |
| WO | 2017222189 | | 12/2017 | |
| WO | 2018092816 | | 5/2018 | |
| WO | 2018092817 | | 5/2018 | |
| WO | 2018105003 | | 6/2018 | |
| WO | WO-2018105003 | A1 * | 6/2018 | ..... C23C 2/06 |
| WO | WO-2019111083 | A1 * | 6/2019 | ..... C21D 1/26 |
| WO | WO-2019111084 | A1 * | 6/2019 | ..... C21D 1/25 |

OTHER PUBLICATIONS

European Search Report—European Application No. 19857221.6 issued on Sep. 17, 2021, citing WO 2018/105003, US 2017/0327919, WO 2017/183349, WO 2018/092816, WO 2018/092817, WO 2017/078278, WO 2017/131053, WO 2017/222189, and KR 10-2017-0075853.

International Search Report—PCT/KR2019/011281 dated Dec. 12, 2019.

* cited by examiner

ULTRA HIGH STRENGTH AND HIGH DUCTILITY STEEL SHEET HAVING EXCELLENT YIELD RATIO AND MANUFACTURING METHOD FOR SAME

TECHNICAL FIELD

The present invention relates to an ultra high-strength and high-ductility steel sheet having an excellent yield ratio and a manufacturing method for manufacturing the same, specifically to an ultra high-strength and high-ductility steel sheet having an excellent yield ratio and suitable as a structural member for cold forming automobiles.

BACKGROUND ART

Due to carbon dioxide emission regulations related to environmental issues, automobile manufacturers have continuously been pursuing weight reductions of automobiles. In order to reduce the weight of an automobile body, a method of reducing a thickness of a steel sheet is most effective. However, in the case of simply reducing the thickness of the steel sheet, stiffness of the automobile body decreases, which may cause a problem, in that passenger safety may not be secured. Therefore, it is essential to apply ultra-high strength steel in order to reduce the weight of the automobile and secure the safety of passengers.

Meanwhile, in general, steel materials tend to have decreasing elongation as strength increases. As such, there are several restrictions in terms of workability in applying ultra-high strength steel to structural members for automobiles requiring difficult formability.

As one method to overcome this, a method of utilizing hot-formed steel has been proposed. Hot-formed steel is formed by heating a steel sheet provided by a steel manufacturer at a high temperature and cooling the same, followed by introducing a low-temperature transformation phase into the steel sheet, thereby securing workability and high strength when manufacturing structural members for automobiles requiring formability. For example, 1.5 GPa-class hot-formed steel has been used commercially for structural members for automobiles, such as A-pillars of automobiles, which have difficult formability and require impact resistance. However, such hot-formed steel is accompanied by a problem of an increase in manufacturing cost due to investment in hot forming equipment of automobile component companies and high temperature heat treatment.

In order to solve such problems, research into steel materials capable of cold forming while securing high strength has been continuously conducted. As an example, Patent Document 1 suggests ultra high-strength steel having a yield strength of 1344 MPa and a tensile strength of 1520 MPa by adding 0.2% to 0.3% of carbon (C) and 2.0% to 3.5% of manganese (Mn) by weight %. The steel material of Patent Document 1 has advantages of an excellent yield strength ratio, excellent impact resistance, and excellent bending characteristics, but has inferior elongation of less than 7%. In this regard, use thereof is limited to production of components having relatively simple shapes during cold forming.

In addition, Patent Document 2 suggests an ultra-high-strength steel sheet having excellent impact characteristics with a tensile strength of 1300 MPa or more and a yield strength of 1000 MPa or more by adding 0.4% to 0.7% of carbon (C) and 12% to 24% of manganese (Mn) by weight %. However, since the steel material of Patent Document 2 also has a low elongation of around 10%, there are restrictions in the application thereof to components having complex shapes during cold forming. In addition, Patent Document 2 accompanies problems of increases in manufacturing costs and processes, since high strength is secured through re-rolling after annealing.

Therefore, as cold-formed steel to replace hot-formed steel, there is a need to develop an ultra-high-strength and high-ductility steel sheet having an excellent yield strength ratio.

PRIOR ART DOCUMENTS

Patent Document 1: Korean Patent No. 10-1586933 (Issue date: Jan. 19, 2016)

Patent Document 2: Korean Laid-Open Patent Application Publication No. 10-2013-0138039 (Publication date: Dec. 18, 2013)

DISCLOSURE

Technical Problem

An aspect of the present invention is to provide an ultra high-strength and high-ductility steel sheet having an excellent yield ratio and a manufacturing method manufacturing the same.

The present invention is not limited to the above technical problem. It would not be difficult for those skilled in the art to understand additional problems of the present invention based on overall context of this specification.

Technical Solution

According to an aspect of the present invention, an ultra high strength and high ductility steel sheet having an excellent yield ratio according to an aspect of the present invention contains, in wt %, 0.1% to 0.3% of carbon (C), 2% or less of silicon (Si), 6% to 10% of manganese (Mn), 0.05% or less of phosphorus (P), 0.02% or less of sulfur (S), 0.02% or less of nitrogen (N), 0.5% or less (excluding 0%) of aluminum (Al), and a balance Fe and inevitable impurities, and further contains at least one selected from the group consisting of 0.1% or less of titanium (Ti), 0.1% or less of niobium (Nb), 0.2% or less of vanadium (V), and 0.5% or less of molybdenum (Mo), wherein the ultra high-strength and high-ductility steel sheet comprises 20 area % or more of retained austenite as a microstructure, the average aspect ratio of the retained austenite being 2.0 or higher.

The steel sheet may further contain one or more selected from the group consisting of nickel (Ni): 0.1 wt % or less, copper (Cu): 0.5 wt % or less and chromium (Cr): 0.1 wt % or less.

The steel sheet may contain one or more among ferrite, annealed martensite and fresh martensite as a residual structure.

The steel sheet may further contain one or more residual structures among ferrite, annealing martensite and fresh martensite in a total fraction of 50 area % to 80 area %.

The steel sheet may have a tensile strength of 1,400 MPa or greater, a yield ratio of 0.7 or greater, and a product of tensile strength and elongation (TS*EL) of 22,000 MPa % or greater.

According to an aspect of the present invention, a method for manufacturing an ultra high-strength and high-ductility steel sheet having an excellent yield ratio, may include heating a slab comprising, by wt % 0.1% to 0.3% of carbon (C), 2% or less of silicon (Si), 6-10% of manganese (Mn), 0.05% or less of phosphorus (P), 0.02% or less of sulfur (S), 0.02% or less of nitrogen (N), 0.5% or less (excluding 0%) of aluminum (Al), and a balance Fe and inevitable impurities, and further comprising one or more selected from the group consisting of 0.1% or less of titanium (Ti), 0.1% or less of niobium (Nb), 0.2% or less of vanadium (V), and 0.5% or less of molybdenum (Mo), in a temperature range of 1050° C. to 1300° C.; preparing a hot-rolled steel sheet by finish hot rolling the heated slab in a temperature range of 800° C. to 1000° C.; winding the hot-rolled steel sheet in a temperature range of 50° C. to 750° C.; preparing a cold-rolled steel sheet by cold rolling the wound hot-rolled steel sheet at a reduction rate of 15% or higher after pickling; and selectively annealing the cold-rolled steel sheet under any one of a first annealing condition and a second annealing condition, when the first annealing condition involves annealing the cold-rolled steel sheet in a temperature range of 600° C. to 720° C. for 10 sec to 3,600 sec, and the second annealing condition involves first annealing in a temperature range of higher than 720° C. and 900° C. or lower for 10 sec to 3,600 sec and cooling, followed by second annealing in a temperature range of 480° C. to 700° C. for 10 sec to 3,600 sec.

The slab may further contain one or more selected from the group consisting of nickel (Ni): 0.1 wt % or less, copper (Cu): 0.5 wt % or less and chromium (Cr): 0.1 wt % or less.

Advantageous Effects

According to an aspect of the present invention, an ultra high-strength and high-ductility steel sheet having an excellent yield ratio and a manufacturing for the same can be provided.

According to a preferable aspect of the present invention, an ultra high-strength and high-ductility steel sheet having a tensile strength of 1,400 MPa or greater while satisfying a yield ratio of 0.7 or greater, and a product of tensile strength and elongation of 22,000 MPa % or greater, thereby being appropriate particularly for cold forming, and a manufacturing method for the same can be provided.

BEST MODE FOR INVENTION

Figure 1:
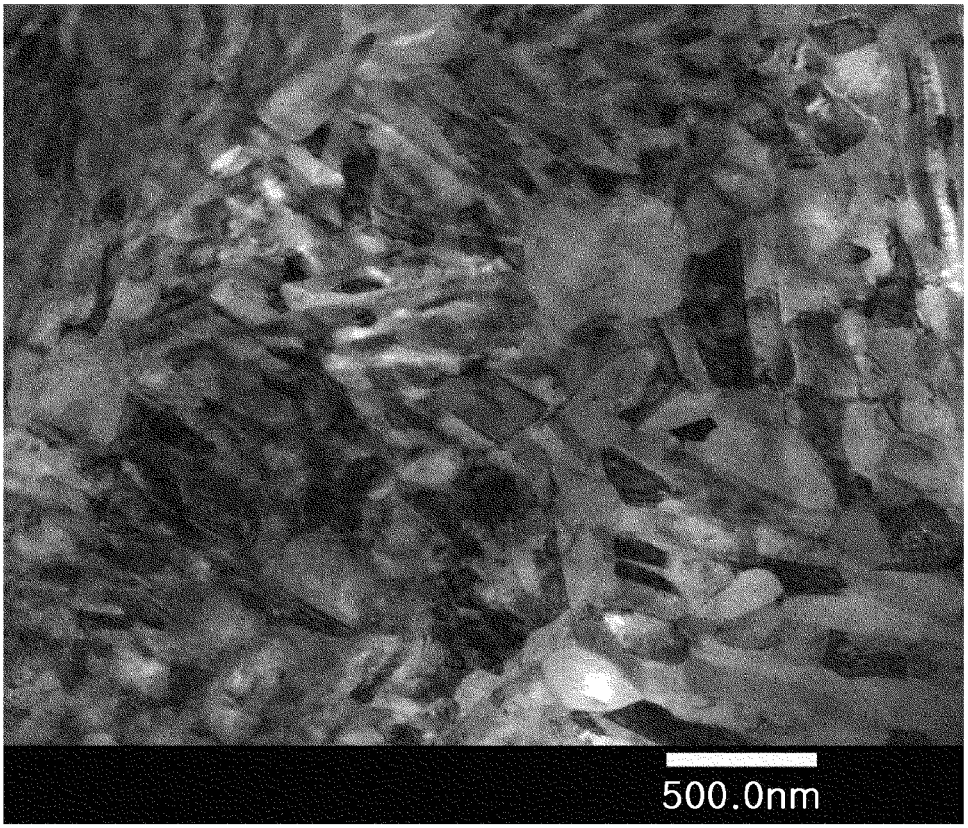
FIG. 1 is a photographic image of a cross-section of Inventive Example 1 observed with a transmission electron microscope (TEM).

The present invention relates to an ultra high-strength and high-ductility steel sheet having an excellent yield ratio and a manufacturing method of manufacturing the same. Hereinafter, preferred embodiments of the present invention will be described. The embodiments of the present invention can be modified to have various other forms, and the scope of the present invention should not be limited to the embodiments described below. Further, the embodiments of the present invention are provided to more fully explain the present invention to those skilled in the art.

According to an aspect of the present invention, an ultra high strength and high ductility steel sheet having an excellent yield ratio according to an aspect of the present invention contains, in wt %, 0.1% to 0.3% of carbon (C), 2% or less of silicon (Si), 6% to 10% of manganese (Mn), 0.05% or less of phosphorus (P), 0.02% or less of sulfur (S), 0.02% or less of nitrogen (N), 0.5% or less (excluding 0%) of aluminum (Al), and a balance Fe and inevitable impurities, and further contains at least one selected from the group consisting of 0.1% or less of titanium (Ti), 0.1% or less of niobium (Nb), 0.2% or less of vanadium (V), and 0.5% or less of molybdenum (Mo), wherein the ultra high-strength and high-ductility steel sheet comprises 20 area % or more of retained austenite as a microstructure, the average aspect ratio of the retained austenite being 2.0 or higher.

Further, the ultra high-strength and high-ductility steel sheet having an excellent yield ratio may further contain one or more selected from the group consisting of nickel (Ni): 0.1 wt % or less, copper (Cu): 0.5 wt % or less and chromium (Cr): 0.1 wt % or less.

Hereinafter, a composition of the steel of the present invention will be described in detail. Otherwise particularly indicated, the symbol "%" indicating a content of each element is based on weight.

According to an aspect of the present invention, an ultra high strength and high ductility steel sheet having an excellent yield ratio according to an aspect of the present invention contains, in wt %, 0.1% to 0.3% of carbon (C), 2% or less of silicon (Si), 6% to 10% of manganese (Mn), 0.05% or less of phosphorus (P), 0.02% or less of sulfur (S), 0.02% or less of nitrogen (N), 0.5% or less (excluding 0%) of aluminum (Al), and a balance Fe and inevitable impurities.

Carbon (C): 0.1% to 0.3%

Carbon (C) is an element effective for strengthening steel. In the present invention, it is an important element added to control stability and secure strength of austenite. In the present invention, 0.1% or more of C may be added to obtain such an effect. A preferable lower limit of a C content may be 0.11%, and a more preferable lower limit may be 0.12%. When a large amount of C is added, however, weldability may be deteriorated. In this regard, the present invention may limit an upper limit of the C content to 0.3%. A preferable upper limit of the C content may be 0.27%, and a more preferable upper limit may be 0.25%.

Silicon (Si): 2% or Less

Silicon (Si) is an element suppressing precipitation of carbides in ferrite and promoting diffusion of carbon in ferrite to austenite, and is an element contributing to stabilization of retained austenite. When a large amount of Si is added, however, hot and cold rolling properties may be significantly deteriorated. Further, silicon oxides may be formed on a steel surface to impair galvanization property. As such, an upper limit of a Si content may be limited to 2% in the present invention. A preferable upper limit of the Si content may be 1.9%, and a more preferable upper limit may be 1.7%.

Meanwhile, the Si content of the present invention may include 0%. That is, an addition of Si may be intentionally excluded in the present invention. As described below, the present invention contains a large amount of manganese (Mn), safety of retained austenite can be easily secured without the Si addition. When considering the Si content inevitably introduced, however, a lower limit of the Si content of the present invention may be 0.03%, 0.05% or 0.1%.

Manganese (Mn): 6% to 10%

Manganese (Mn) is an element effective in the formation and stabilization of retained austenite while suppressing transformation of ferrite, and is an effective element in securing mechanical properties of steel. In the present invention, 6% or more of Mn may be added to obtain such an effect. A preferable lower limit of a Mn content may be 6.2%, and a more preferable lower limit of the Mn content may be 6.5%. When a large amount of Mn is added, however, it may cause an increase in alloy cost and deterioration of spot weldability. As such, the upper limit of the Mn content may be limited to 10% in the present invention. A preferable upper limit of the Mn content may be 9.8%, and a more preferable upper limit may be 9.5%.

Phosphorous (P): 0.05% or Less

Phosphorous (P) is a solid solution strengthening element. When a large amount of P is added, however, weldability may be deteriorated, and a risk of generating brittleness of the steel may increase. Accordingly, an upper limit of a P content may be limited to 0.05% in the present invention. Preferably, the upper limit of the P content may be limited to 0.02%. When considering the inevitably introduced P content, a lower limit of the P content of the present invention may be 0.001% or 0.002%.

Sulfur (S): 0.02% or Less

Sulfur (S) is an impurity element inevitably contained in steel, and is an element which impairs ductility and weldability of steel. Accordingly, an upper limit of a S content may be limited to 0.02% in the present invention to secure ductility and weldability of the steel. Preferably, the upper limit of the S content may be limited to 0.015%. When considering the inevitably introduced S content, a lower limit of the S content of the present invention may be 0.001% or 0.002%.

Nitrogen (N): 0.02% or Less

Nitrogen (N) is a solid solution strengthening element. When a large amount of N is added, however, there is a high risk of brittleness, and casting quality may be deteriorated due to excessive precipitation of AlN in result of binding to aluminum (Al). Accordingly, in the present invention, an upper limit of an N content may be limited to 0.02%, and preferably, the upper limit of the N content may be limited to 0.015%. When considering the inevitably introduced N content, a lower limit of the N content of the present invention may be 0.001% or 0.002%.

Aluminum (Al): 0.5% or Less (Excluding 0%)

Aluminum (Al) is added for deoxidation of steel and is an element contributing to stabilization of retained austenite by suppressing formation of carbides in ferrite. In the present invention, aluminum (Al) may be added to obtain such an effect. A preferable lower limit of an Al content may be 0.005%, and a more preferable lower limit of the Al content may be 0.01%. When a large amount of aluminum (Al) is added, however, a tensile strength of the steel decreases, and soundness of a slab is deteriorated through a reaction with a mold flux during casting. In addition, plateability may be deteriorated by forming a surface oxide. As such, an upper limit of the Al content may be limited to 0.5% in the present invention. A preferable upper limit of the Al content may be 0.45%, and a more preferable upper limit may be 0.4%.

The remaining component of the present invention is iron (Fe). However, unintended impurities from raw materials or surrounding environments may inevitably be mixed in conventional manufacturing processes, and thus cannot be completely excluded. As these impurities are known to anyone of ordinary skill in the manufacturing processes, descriptions thereof will not be specifically mentioned in the present specification.

An ultra-high strength and high-ductility steel sheet having an excellent yield ratio according to an aspect of the present invention may further contain one or more selected from the group consisting of, by weight %, titanium (Ti): 0.1% or less, niobium (Nb): 0.1% or less, vanadium (V): 0.2% or less, and molybdenum (Mo): 0.5% or less.

Titanium (Ti): 0.1% or Less

Titanium (Ti), as a fine carbide-forming element, is an element contributing to securing yield strength and tensile strength. In addition, Ti forms TiN precipitates by binding with nitrogen (N) in steel as a nitride-forming element, and thus is an element contributing to a reduced risk of crack occurrence during casting by suppressing the formation of AlN precipitates. In the present invention, Ti may be added to obtain such an effect. When a large amount of Ti is added, however, coarse carbides are precipitated, and strength and elongation may be reduced due to a reduction in an amount of carbon in the steel. Further, nozzle clogging may occur during casting. As such, an upper limit of a Ti content may be limited to 0.1%. A preferable titanium Ti content may be 0.09%, and a more preferable Ti content may be 0.08%. In addition, a lower limit of the Ti content is not specifically limited in the present invention, but may be 0.005% or 0.01%.

Niobium (Ni): 0.1% or Less

Niobium (Nb) is an element segregated at an austenite grain boundary, to suppress coarsening of austenite grains during annealing and forming fine carbides to contribute to an increase in strength. In the present invention, Nb may be added to obtain such an effect. When a large amount of Nb is added, however, coarse carbides are precipitated, strength and elongation may be reduced due to a reduction in an amount of carbon in steel. Further, manufacturing costs may be increased. As such, an upper limit of an Nb content may be limited to 0.1%. A preferable Nb content may be 0.09%, and a more preferable Nb content may be 0.08%.

Vanadium (V): 0.2% or Less

Vanadium (V) is an element which reacts with C or N in steel to form carbides or nitrides and plays an important role in increasing a yield strength of steel by forming fine precipitates at low temperatures. In the present invention, V may be added to obtain such an effect. When a large amount of V is added, however, coarse carbides are precipitated, the strength and elongation may be reduced due to a reduced carbon content in steel, and manufacturing costs may increase. As such, an upper limit of a V content may be 0.2%. A preferable upper limit of the V content may be 0.18%.

Molybdenum (Mo): 0.5% or Less

Molybdenum (Mo) is an element which forms carbides and serves to improve a yield strength and a tensile strength by finely maintaining sizes of precipitates when added in combination with carbide- or nitride-forming elements such as titanium (Ti), niobium (Nb), vanadium (V), or the like. In the present invention, Mo may be added to obtain such an effect. When a large amount of Mo is added, however, the above-described effects are saturated, and there may be a problem that manufacturing costs increase. As such, an upper limit of a Mo content may be limited to 0.5% in the present invention. A preferable upper limit of the Mo content may be 0.4%.

The ultra high-strength and high-ductility steel sheet according to an aspect of the present invention may further contain one or more selected from the group consisting of, by weight %, nickel (Ni): 1% or less, copper (Cu): 0.5% or less, and chromium (Cr): 1% or less.

Ni, Cu, and Cr are elements contributing to stabilization of austenite by reacting in combination with C, Si, Al, or the like, described above. However, in the case in which Ni, Cu and Cr are added in excessive amounts, manufacturing costs may significantly increase. As such, upper limits thereof may be limited to 1%, 0.5% and 1%, respectively. In addition, since Cr may cause brittleness during hot rolling, it is more preferable that Cr be added together with Ni.

Hereinafter, a microstructure of the ultra high-strength and high-ductility steel sheet according to an aspect of the present invention will be described in more detail. Hereinafter, unless otherwise specified, fractions and aspect ratios of the microstructure mean values measured based on a cross-section of the steel sheet.

The ultra high-strength and high-ductility steel sheet according to an aspect of the present invention may include retained austenite as a microstructure. The retained austenite is an effective structure for securing strength and elongation properties of steel, and can thus be limited to a fraction of 20 area % or more based on the cross-section of the steel sheet.

The ultra high-strength and high-ductility steel sheet according to an aspect of the present invention may include one or more among ferrite, annealed martensite and fresh martensite as a residual structure, and a total fraction of the residual structures based on the cross-section of the steel sheet may be 50 area % to 80 area %. The ultra high-strength and high-ductility steel sheet according to an aspect of the present invention is a so-called metamorphic organic plastic steel (TRIP) in which the elongation increases due to transformation of the retained austenite into martensite when an external deformation is applied. For an optimal combination of strength and elongation, mechanical stability of retained austenite and a fraction thereof are important factors. When the fraction of retained austenite exceeds 50 area %, the mechanical stability of the retained austenite decreases, and thus, the total fraction of the residual structures may be limited to 50 area % or more. Alternately, when the residual structures exceed 80 area %, a desired fraction of the retained austenite cannot be secured. In this regard, the total fraction of the residual structures may be limited to 80 area % or less.

An average aspect ratio of the retained austenite may be 2.0 or more. As used herein, the expression "aspect ratio" means a value obtained by dividing a length of a long axis of a grain by a length of a short axis. In the present invention, the average aspect ratio of the austenite refers to an average value of the aspect ratios of austenite grains observed in the cross-section. When the average aspect ratio of the retained austenite is 2.0 or more, the retained austenite exists in a needle-like shape and has high safety. In addition, the elongation can be effectively secured by preventing the propagation of cracking.

The ultra high-strength and high-ductility steel sheet according to an aspect of the present invention simultaneously satisfies the fraction of retained austenite of 20 area % or more and the average aspect ratio of retained austenite of 2.0 or more, and thus has an excellent yield strength and can secure a yield ratio (yield strength/tensile strength) of 0.7 or more while having a tensile strength of 1,400 MPa or more. Furthermore, a product of the tensile strength and elongation of 22,000 MPa % or more can be secured.

The tensile strength after hot forming of hot forming steel which has currently been used most widely is about 1,470 MPa. In contrast, the ultra high-strength and high-ductility steel sheet according to an aspect of the present invention has a tensile strength of 1,400 MPa or more and a yield ratio of 0.7 or more. In this regard, cold-forming steel, which can replace hot forming steel, can be provided. In addition, a structural member for automobiles, especially B-pillars, is manufactured by hot forming steel for reasons such as structural difficulty, crash stability, or the like; however, the ultra high-strength and high-ductility steel sheet according to an aspect of the present invention is secured with the product of tensile strength and elongation of 22,000 MPa % or more. Accordingly, steel for cold forming, particularly appropriate for manufacturing the structural members for automobiles.

In addition, the ultra high-strength and high-ductility steel sheet according to an aspect of the present invention may further include a hot-dip galvanizing layer or an alloying hot-dip galvanizing layer.

Hereinafter, the manufacturing method of the present invention will be described in more detail.

An ultra high-strength and high-ductility steel sheet having an excellent yield ratio according to an aspect of the present invention may be manufactured by heating a slab having the above composition in a temperature range of 1050° C. to 1300° C., preparing a hot-rolled steel sheet by finish hot rolling the heated slab in a temperature range of 800° C. to 1000° C., winding the hot-rolled steel sheet in a temperature range of 50° C. to 750° C., preparing a cold-rolled steel sheet by cold rolling the wound hot-rolled steel sheet at a reduction rate of 15% or higher after pickling, and selectively annealing the cold-rolled steel sheet under any one of a first annealing condition and a second annealing condition, where the first annealing condition involves annealing the cold-rolled steel sheet in a temperature range of 600° C. to 720° C. for 10 sec to 3,600 sec, and the second annealing condition involves first annealing in a temperature range of higher than 720° C. and 900° C. or lower for 10 sec to 3,600 sec and cooling, followed by second annealing in a temperature range of 480° C. to 700° C. for 10 sec to 3,600 sec.

Slab Heating

The slab composition of the present invention corresponds to the composition of the previously described ultra high-strength and high-ductility steel sheet having an excellent yield ratio, and thus, a description thereof will be replaced with the description of the composition of the previously described ultra high-strength and high-ductility steel sheet having an excellent yield ratio.

In the present invention, the slab may be heated prior to hot rolling to perform homogenization. When a slab heating temperature is less than 1,050° C., a problem of a rapid increase in rolling load may arise during subsequent hot rolling. In contrast, when the slab heating temperature exceeds 1,300° C., not only an energy cost increases but also an amount of surface scales increases, thereby leading to material loss. In the case in which a large amount of manganese (Mn) is contained, a liquid phase may exist. Accordingly, a slab heating temperature range of the present invention may be 1,050° C. to 1,300° C.

Hot Rolling

A hot-rolled steel sheet may be manufactured by hot rolling the heated slab. When a hot-rolling temperature is below 800° C., a rolling load may rapidly increase. In contrast, a hot-rolling temperature higher than 1,000° C. may rise problems of surface defects due to surface scale and a reduced lifespan of a roller. Accordingly, a finish hot rolling temperature of the present invention may be 800° C. to 1,000° C.

Winding

The hot-rolled steel sheet may be wound after hot rolling. When a winding temperature excessively high, a large amount of steel surface scale is formed, thereby deteriorating plateability. As such, the winding temperature of the present invention may be 750° C. or below. Meanwhile, a steel sheet containing 5% or more of Mn does not need to have a specifically limited lower limit for a winding temperature, as ferrite does not transform when cooled to room temperature after hot rolling and winding due to increased hardenability. However, in the case of the winding temperature below 50° C., a cooling process by spraying cooling water must be accompanied to reduce a temperature of the steel sheet, which inevitably increases the process cost. Therefore, the winding temperature range of the present invention may be 50° C. to 750° C.

In addition, a transformation initiation temperature Ms of martensite may be lowered as Mn is added, and martensite may be formed at room temperature. In this case, hardness of the hot-rolled steel sheet significantly increases due to a martensitic structure, and a load of the cold-rolled steel sheet may be increased. Accordingly, heat treatment may further be selectively carried out for the hot-rolled sheet before cold rolling.

Pickling and Cold Rolling

The wound hot-rolled steel sheet is uncoiled and then pickled to remove an oxide layer. The cold-rolled steel sheet can be manufactured by performing cold rolling to control a thickness and a shape of the steel sheet according to customer requirements. When a cold reduction ratio does not reach a certain level, it may be difficult to secure a target fraction and an average aspect ratio of the retained austenite in the present invention. This is because a driving force for reverse transformation and growth of the austenite is insufficient during final annealing when the cold reduction ratio is low. As such, the cold reduction ratio of the present invention may be 15% or more. In addition, as a large amount of Mn is contained in the present invention and the hot-rolled steel sheet has thus a relatively high strength, an excessive load of cold-rolling facilities may be caused when the cold-rolling reduction ratio exceeds a certain level. Accordingly, the cold reduction ratio of the present invention may be 50% or less, and a more preferable upper limit of the cold reduction ratio may be 45%.

Annealing

After cold rolling, annealing can be performed under certain conditions. In particular, in order to secure physical properties required by the present invention, the area fraction and the average aspect ratio of the retained austenite must be controlled to be at a desired level, which can be achieved by strict control of the annealing conditions. The annealing of the present invention may be carried out by selecting any one of a first annealing condition involving annealing at a relatively low annealing temperature and a second annealing condition involving additionally performing a subsequent heat treatment after annealing at a relatively high annealing temperature.

That is, in the case of the first annealing condition, annealing of the cold-rolled steel sheet is performed for 10 sec to 3,600 sec in a temperature range of 600° C. to 720° C. In the case of the second annealing condition, the first annealing is performed for 10 sec to 3,600 sec in a temperature range of greater than 720° C. and 900° C. or below, cooling is performed until reaching room temperature, and second annealing is performed in a temperature range of 480° C. to 700° C. for 10 sec to 3,600 sec.

Hereinafter, reasons for limiting the first annealing condition among the annealing conditions of the present invention will be described in more detail.

The annealing according to the first annealing condition may be performed for 10 sec to 3,600 sec in the temperature range of 600° C. to 720° C.

The temperature range of 600° C. to 720° C. corresponds to a two-phase region temperature range for a steel component system of the present invention. When the annealing is performed in the two-phase region, elements such as carbon (C) and manganese (Mn) are concentrated in austenite, thereby increasing stability of austenite and remaining at room temperature. Subsequently, when a deformation is applied to the steel sheet, the retained austenite is transformed into martensite, delaying necking of the steel plate, thereby contributing to improvement of elongation and strength of the steel sheet.

When the annealing temperature is less than 600° C. in the first annealing condition, an austenite fraction in the two-phase region is so small that the austenite fraction remaining in the steel sheet cannot be sufficiently secured, and accordingly, desired mechanical properties cannot be secured. In contrast, when the annealing temperature exceeds 720° C. in the first annealing condition, it may be difficult to secure the retained austenite fraction of a final steel sheet to be 20 area % or more due to insufficient stability of two-phase region and single phase austenite, and desired mechanical properties cannot be secured. Therefore, the annealing temperature range of the first annealing condition of the present invention may be 600° C. to 720° C.

When the annealing is performed under the first annealing condition, it is preferable to perform heat treatment for at least 10 sec or more in consideration of phase transformation mechanism and driving force. As a time for the annealing increases, it approaches closer to an equilibrium phase, enabling a uniform structure to be obtained; however, there may be a problem that a process cost increases. In addition, when the annealing time exceeds 3,600 sec, the average aspect ratio of the austenite of 2.0 or higher cannot be realized due to grain growth and recrystallization of the austenite. Therefore, the annealing time of the first annealing condition of the present invention may be 10 sec to 3,600 sec.

Hereinafter, reasons for limiting the second annealing condition among the annealing conditions will be described in more detail.

Annealing according to the second annealing condition may involve first annealing in the temperature range of higher than 720° C. and 900° C. or less for 10 sec to 3,600 sec, and cooling to room temperature followed by second annealing in the temperature range of 480° C. to 700° C. for 10 sec to 3,600 sec.

The temperature range of higher than 720° C. and 900° C. or less corresponds to a two-phase region in which the austenite fraction is excessive for the steel component system of the present invention or a single austenite phase temperature range. As such, when the annealing is performed in the temperature range of higher than 720° C. and 900° C. or less, safety of austenite is greatly reduced, and most of the austenite is transformed into martensite during cooling, and only some austenite remains. Since the retained austenite is low in safety and its fraction is low, the safety and fraction of austenite can be secured through additional annealing. However, even when the first annealing temperature of the second annealing exceeds 900° C., the target physical properties in the present invention can be secured, but problems, such as a reduced lifespan of an annealing furnace due to high temperature heat treatment and deteriorated plateability. Due to an increased amount of surface oxides of the steel sheet, may arise. Accordingly, the first annealing temperature of the second annealing condition of the present invention may be limited to 900° C. or less.

As the annealing according to the second annealing condition of the present invention involves first annealing in the temperature range of higher than 720° C. and 900° C. or less for 10 sec to 3, 600 sec, and cooling to room temperature followed by second annealing in the temperature range of 700° C. or less for 10 sec to 3,600 sec, the stability and fraction of austenite can be secured. The second annealing condition of the present invention is to perform annealing under the first annealing condition; however, in the case in which the annealing is performed beyond the annealing temperature range limited by the first annealing condition, it may be understood as supplementary annealing to secure the safety and fraction of austenite.

Reasons for limiting the temperature range and annealing time of the second annealing to 480° C. to 700° C. and 10 sec to 3,600 sec are as follows.

In 480° C. to 600° C., which is a relatively low temperature range among the second annealing temperature range, supersaturated carbon atoms in martensite may be redistributed to austenite, which is partially retained after the first annealing, and accordingly, there may be an effect of increasing stability of austenite. Considering the phase transformation mechanism and driving force, such an effect can be achieved when annealing is performed at a corresponding temperature for 10 seconds or longer. When the second annealing time at the corresponding temperature exceeds a certain period, carbides may be precipitated, rather than redistribution of carbon between phases, and the elongation tends to decrease. Therefore, it is preferable to limit the second annealing time at said temperature to 3,600 seconds or less.

In the second annealing temperature range of 600° C. to 700° C., a relatively high temperature range, reverse transformation occurs from the first annealing structure to austenite, thereby increasing the austenite fraction. Considering the phase transformation mechanism and driving force, such an effect can be achieved when second annealing is performed for 10 seconds or more at the corresponding temperature. As the second annealing time at the corresponding temperature increases, a uniform structure close to the equilibrium phase can be obtained, but a problem in that the process cost is excessively consumed may occur. Therefore, it is preferable to limit the second annealing time at said temperature to 3,600 seconds or less.

When the second annealing temperature exceeds 700° C., the austenite fraction in the two-phase region increases, and accordingly, the stability of the eventually remaining austenite decreases, or the average aspect ratio of austenite is reduced to below 2.0, thereby making it difficult to secure the target physical properties of the present invention. In addition, as the second annealing condition, in the case in which the first annealing is performed before the second annealing is performed, the reverse austenite transformation is accelerated at the same annealing temperature during the second annealing, resulting in an increase in the fraction of the two-phase region austenite. Therefore, an upper limit of the second annealing temperature of the second annealing condition is preferably limited to 700° C., somewhat lower than the upper limit of 720° C., which is the upper limit of the annealing temperature of the first annealing condition.

The method for manufacturing an ultra high-strength and high-ductility steel sheet according to an embodiment of the present invention may involve hot-dip galvanizing or alloying hot-dip galvanizing on the cold-rolled steel sheet.

MODE FOR INVENTION

Hereinafter, the present invention will be described in more detail with reference to the following Examples.

Example

After the steel having the component composition of Table 1 was dissolved in a vacuum with a 30 Kg ingot, the steel was maintained at a temperature of 1200° C. for 1 hour and hot-rolled to complete finish rolling at 900° C., thereby preparing a hot-rolled steel sheet. The hot-rolled steel sheet was loaded into a furnace heated to 600° C. in advance and maintained for 1 hour, and then cooled in the furnace to hot-roll and wind the steel sheet. After cooling to room temperature and pickling, the steel was subject to cold rolling and annealing under the conditions of Table 2 below. In Table 2, a sample for which only the first annealing conditions are described refers to the case in which first-stage annealing conditions are applied, and a sample for which both first and second annealing conditions are described means the case in which two-stage annealing conditions are applied. Microstructure observation and mechanical property evaluation were performed on thus-prepared cold-rolled steel sheet, and results thereof are shown in Table 3 below. The austenite fraction of each sample was measured using XRD, and the physical properties of each sample were evaluated by measuring physical properties in a rolling direction and in a vertical direction for a JIS standard tensile sample.

TABLE 1

| Steel | Composition (wt %) | | | | | | | | | | |
|---|---|---|---|---|---|---|---|---|---|---|---|
| type | C | Si | Mn | Al | Ti | Nb | V | Mo | P | S | N |
| IS 1 | 0.14 | 1 | 8 | 0.025 | 0.06 | 0.04 | — | 0.25 | 0.008 | 0.004 | 0.006 |
| IS 2 | 0.14 | 1 | 9 | 0.03 | 0.06 | 0.04 | — | 0.25 | 0.009 | 0.006 | 0.005 |
| IS 3 | 0.14 | 1.5 | 9 | 0.019 | 0.06 | 0.04 | — | 0.25 | 0.007 | 0.009 | 0.006 |
| IS 4 | 0.14 | 1 | 7 | 0.024 | 0.06 | 0.04 | — | 0.25 | 0.01 | 0.01 | 0.004 |
| IS 5 | 0.19 | 0.5 | 7 | 0.016 | 0.03 | — | 0.1 | — | 0.009 | 0.009 | 0.007 |
| **CS 1 | 0.06 | 1 | 8.5 | 0.023 | — | — | — | — | 0.008 | 0.008 | 0.006 |

*IS: Inventive Steel
**CS: Comparative Steel

TABLE 2

| | | Cold | 1st annealing | | 2nd annealing | |
|---|---|---|---|---|---|---|
| Steel type | Type | Reduction rate (%) | Temp (° C.) | Time (sec) | Temp (° C.) | Time (sec) |
| IS 1 | IE 1 | 30 | 690 | 45 | — | — |
| | IE 2 | 30 | 670 | 60 | — | — |
| | CE 1 | 30 | 550 | 60 | — | — |
| | CE 2 | 30 | 780 | 46 | | |
| | CE 3 | 30 | 780 | 46 | 460 | 18 |
| | IE 3 | 30 | 780 | 46 | 500 | 18 |
| | IE 4 | 30 | 780 | 46 | 530 | 18 |
| | IE 5 | 30 | 780 | 46 | 620 | 18 |
| IS 2 | IE 6 | 30 | 670 | 60 | — | — |
| IS 3 | IE 7 | 30 | 670 | 60 | — | — |
| | IE 8 | 30 | 690 | 60 | — | — |
| | IE 9 | 22 | 650 | 60 | — | — |

TABLE 2-continued

| Steel type | Type | Cold Reduction rate (%) | 1st annealing Temp (° C.) | 1st annealing Time (sec) | 2nd annealing Temp (° C.) | 2nd annealing Time (sec) |
|---|---|---|---|---|---|---|
| | IE 10 | 22 | 670 | 60 | — | — |
| | IE 11 | 22 | 690 | 60 | — | — |
| | CE 4 | 11 | 670 | 60 | — | — |
| | CE 5 | 11 | 690 | 60 | — | — |
| IS 4 | CE 6 | 43 | 780 | 46 | 500 | 7200 |
| | IE 12 | 43 | 800 | 60 | 680 | 48 |
| | CE 7 | 43 | 800 | 60 | 710 | 48 |
| | CE 8 | 43 | 800 | 60 | 740 | 48 |
| IS 5 | CE 9 | 43 | 750 | 46 | — | — |
| | CE 10 | 43 | 750 | 46 | 400 | 7200 |
| | CE 11 | 43 | 750 | 46 | 460 | 18 |
| | IE 13 | 43 | 750 | 46 | 500 | 18 |
| CS 1 | CE 12 | 43 | 810 | 61 | 640 | 48 |
| | CE 13 | 43 | 810 | 61 | 650 | 48 |

*IS: Inventive Steel
**CS: Comparative Steel
*IE: Inventive Example
**CE: Comparative Example

TABLE 3

| Steel | Type | Structure: Retained Austenite Fraction (area %) | Structure: Retained Austenite Aspect ratio | Properties: YS (MPa) | Properties: TS (MPa) | Properties: El (%) | Properties: YR | Properties: TS*El (MPa %) |
|---|---|---|---|---|---|---|---|---|
| IS 1 | IE 1 | 27 | 4.5 | 1252 | 1419 | 17.2 | 0.88 | 24407 |
| | IE 2 | 22 | 5.6 | 1357 | 1404 | 16.8 | 0.97 | 23587 |
| | CE 1 | 12 | 4.3 | 1406 | 1507 | 10.5 | 0.93 | 15824 |
| | CE 2 | 18 | 4.5 | 885 | 1841 | 9.2 | 0.48 | 16937 |
| | CE 3 | 17 | 4.6 | 1368 | 1508 | 14.3 | 0.91 | 21564 |
| | IE 3 | 24 | 4 | 1447 | 1478 | 17.8 | 0.98 | 26308 |
| | IE 4 | 26 | 3.5 | 1371 | 1450 | 18.6 | 0.95 | 26970 |
| | IE 5 | 31 | 2.7 | 1175 | 1418 | 20.9 | 0.83 | 29636 |
| IS 2 | IE 6 | 35 | 2.2 | 1229 | 1457 | 22.1 | 0.84 | 32200 |
| IS 3 | IE 7 | 45 | 2.6 | 1257 | 1474 | 25.1 | 0.85 | 36997 |
| | IE 8 | 47 | 2.2 | 1151 | 1498 | 22.1 | 0.77 | 33106 |
| | IE 9 | 41 | 3.1 | 1390 | 1484 | 17.2 | 0.94 | 25525 |
| | IE 10 | 32 | 2.4 | 1315 | 1479 | 19.4 | 0.89 | 28693 |
| | IE 11 | 39 | 2.1 | 1162 | 1546 | 23.9 | 0.75 | 36949 |
| | CE 4 | 15 | 1.5 | 979 | 1432 | 15.3 | 0.68 | 21910 |
| | CE 5 | 18 | 1.3 | 948 | 1472 | 13.2 | 0.64 | 19430 |
| IS 4 | CE 6 | 18 | 3.5 | 1547 | 1521 | 14.3 | 1.02 | 21750 |
| | IE 12 | 35 | 2.3 | 1010 | 1497 | 18.7 | 0.67 | 27994 |
| | CE 7 | 23 | 1.9 | 503 | 1670 | 12.4 | 0.3 | 20708 |
| | CE 8 | 19 | 1.3 | 784 | 1807 | 8.1 | 0.43 | 14637 |
| IS 5 | CE 9 | 17 | 4.3 | 968 | 2052 | 7.7 | 0.47 | 15800 |
| | CE 10 | 17 | 3.8 | 1588 | 1583 | 11.5 | 1 | 18205 |
| | CE 11 | 18 | 2.9 | 1538 | 1505 | 14 | 1.02 | 21070 |
| | IE 13 | 26 | 3.5 | 1489 | 1494 | 14.8 | 1 | 22111 |
| CS 1 | CE 12 | 17 | 3.1 | 613 | 1405 | 17.7 | 0.44 | 24869 |
| | CE 13 | 13 | 2.5 | 541 | 1591 | 9.1 | 0.34 | 14478 |

*IS: Inventive Steel
**CS: Comparative Steel
*IE: Inventive Example
**CE: Comparative Example As shown in Tables 1 to 3, in the case of Inventive Examples 1 to 13 which satisfy all of alloy compositions and manufacturing conditions of the present invention, the tensile strength (TS) of 1400 MPa or more and the yield strength ratio (YR) of 0.7 or more as well as the product (TS*E1) of the tensile strength and elongation of 22,000 MPa % or more are satisfied. That is, Inventive Examples 1 to 13 secure ultra-high strength as well as excellent yield strength and elongation, and thus have physical properties appropriate for a steel material for cold forming, which can replace hot-formed steel.

Figure 2:
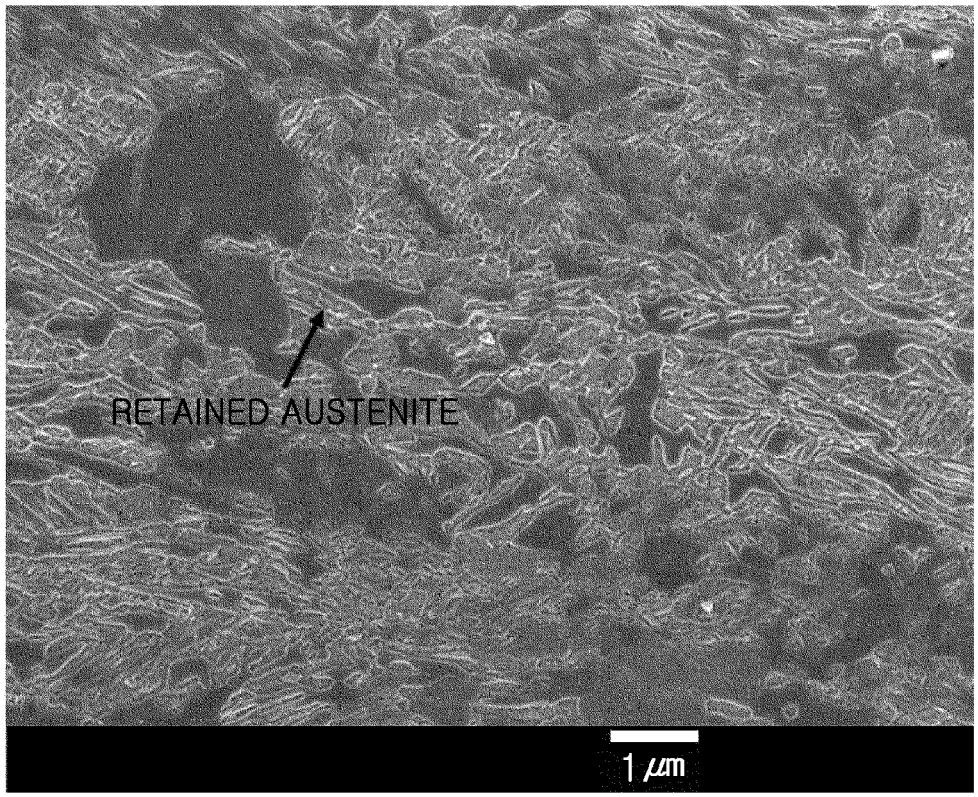
FIG. 2 is a photographic image of a cross-section of Inventive Example 1 observed with a scanning electron microscope (SEM).

The excellent physical properties of Inventive Examples 1 to 13 are characteristics resulting from the fraction and aspect ratio of the retained austenite structure and ultra-fine formation of crystal grains and precipitates. FIG. 1 is a photographic image of a cross-section of Inventive Example 1 observed with a transmission electron microscope (TEM), and shows that most of the microstructures are significantly fine with a size of 1 μm or less, so that strength and elongation can be effectively secured. FIG. 2 is a photographic image of a cross-section of Inventive Example 1 observed with a scanning electron microscope (SEM), and shows that the retained austenite is formed to have a needle shape and the average aspect ratio has a value of 2.0 or more.

In contrast, in the case of Comparative Examples 1 to 13 which do not satisfy any one or more of the alloy compositions and manufacturing conditions of the present invention, any one or more of the fraction and the average aspect ratio of the retained austenite structure of the present invention are not satisfied. In addition, the target physical properties of the present invention are not secured.

In the case of Comparative Examples 1 and 2, the alloy composition of the present invention is satisfied, but the retained austenite fraction was less than 20 area % as the annealing temperatures were 550° C. and 780° C., respectively, beyond the range of the present invention, when the first annealing condition was applied. In addition, since Comparative Examples 1 and 2 do not satisfy the range of the retained austenite fraction of the present invention, the yield ratio is less than 0.7 or the product of tensile strength and elongation is less than 22,000 MPa %, thereby failing to secure the target physical properties.

In the case of Comparative Examples 3 and 11, the alloy composition of the present invention is satisfied, and the first annealing temperature exceeds 720° C., thus applying the second annealing condition; however, the second annealing temperature was 460° C., which is below the range of the present invention, thereby confirming that the retained austenite fraction is less than 20 area %. In addition, since Comparative Examples 3 and 11 do not satisfy the range of the retained austenite fraction of the present invention, the product of the tensile strength and elongation is less than 22,000 MPa %, thus failing to secure the target physical properties.

In the case of Comparative Examples 7 and 8, the alloy composition of the present invention is satisfied, and the first annealing temperature exceeds 720° C., thus applying the second annealing condition; however, the second annealing temperatures were 710° C. and 740° C., which are below the range of the present invention, thereby confirming that the retained austenite fraction is less than 20 area %. In addition, since Comparative Examples 7 and 8 do not satisfy the average aspect ratio value of the retained austenite of the present invention, the yield ratio is less than 0.7, and the product of tensile strength and elongation is less than 22,000 MPa %, thus failing to secure the target physical properties.

In the case of Comparative Examples 4 and 5, the alloy composition and annealing conditions of the present invention are satisfied, but the cold reduction ratio is 11%, which does not reach the range of the present invention. This results in the fraction of retained austenite of less than 20 area %, and the average aspect ratio of the retained austenite of less than 2.0. In addition, as Comparative Examples 4 and 5 do not satisfy the retained austenite fraction and the average aspect ratio value of the present invention, the yield ratio is less than 0.7 and the product of tensile strength and elongation is less than 22,000 MPa %, thereby failing to secure the target physical properties.

In the case of Comparative Examples 6 and 10, the alloy composition of the present invention is satisfied, and the first annealing temperature exceeds 720° C., thus applying the second annealing condition; however, the second annealing time was 7200 sec, which is beyond the range of the present invention, thereby confirming that the retained austenite fraction is less than 20 area %. In addition, since Comparative Examples 6 and 10 do not satisfy the retained austenite fraction of the present invention, the product of tensile strength and elongation is less than 22,000 MPa %, thereby failing to secure the target physical properties.

In the case of Comparative Examples 12 and 13, the cold rolling conditions and the annealing conditions of the present invention are satisfied, but the carbon (C) content does not fall within the range of the present invention, thereby confirming that the retained austenite fraction is less than 20 area %. In addition, as Comparative Examples 12 and 13 do not satisfy the retained austenite fraction of the present invention, the yield ratio is less than 0.7, thus failing to secure the target physical properties.

While exemplary embodiments have been shown and described above, it will be apparent to those skilled in the art that modifications and variations could be made without departing from the scope of the present invention as defined by the appended claims.

The invention claimed is:

1. A steel sheet comprising, in wt %:

0.1% to 0.3% of carbon (C), 2% or less of silicon (Si), 7-10% of manganese (Mn), 0.05% or less of phosphorus (P), 0.02% or less of sulfur(S), 0.02% or less of nitrogen (N), 0.5% or less excluding 0% of aluminum (Al), one or more selected from the group consisting of 0.1% or less of titanium (Ti), 0.1% or less of niobium (Nb), 0.2% or less of vanadium (V), and 0.5% or less of molybdenum (Mo), and a balance Fe and inevitable impurities;

a microstructure comprising: 20 area % or more of retained austenite, wherein grains of the retained austenite have an average aspect ratio being 2.0 or higher;

a tensile strength of 1,400 MPa or greater, a yield ratio of 0.7 or greater, and a product of tensile strength and elongation (TS*EL) of 22,000 MPa % or greater.

2. The steel sheet of claim 1, further comprising: one or more selected from the group consisting of nickel (Ni): 0.1 wt % or less, copper (Cu): 0.5 wt % or less and chromium (Cr): 0.1 wt % or less.

3. The steel sheet of claim 1, wherein the microstructure further comprises: one or more among ferrite, annealed martensite and fresh martensite as a residual structure.

4. The steel sheet of claim 1, wherein the microstructure further comprises: one or more residual structures among ferrite, annealing martensite and fresh martensite in a total fraction of 50 area % to 80 area %.

* * * * *